US009817347B2

(12) United States Patent
Fujii et al.

(10) Patent No.: US 9,817,347 B2
(45) **Date of Patent: *Nov. 14, 2017**

(54) FIXING DEVICE, FIXING METHOD, AND IMAGE FORMING APPARATUS

(71) Applicant: RICOH COMPANY, LTD, Tokyo (JP)

(72) Inventors: Tomohiko Fujii, Osaka (JP); Masahiro Samei, Kanagawa (JP); Tamotsu Ikeda, Kanagawa (JP); Yoshihiro Fukuhata, Hyogo (JP); Minoru Toyoda, Kanagawa (JP); Yoshiharu Takahashi, Tokyo (JP); Daisuke Inoue, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/223,611

(22) Filed: Jul. 29, 2016

(65) Prior Publication Data

US 2017/0045850 A1 Feb. 16, 2017

(30) Foreign Application Priority Data

Aug. 10, 2015 (JP) ..... 2015-158343

(51) Int. Cl.
*G03G 15/20* (2006.01)

(52) U.S. Cl.
CPC ..... *G03G 15/2053* (2013.01); *G03G 15/2089* (2013.01); *G03G 2221/1657* (2013.01)

(58) Field of Classification Search
CPC ..... G03G 15/2053; G03G 15/2032; G03G 15/2064; G03G 15/2067; G03G 15/2089; G03G 2221/1657; F16C 9/00
USPC ..... 399/328, 329, 320
See application file for complete search history.

(56) References Cited

U.S. PATENT DOCUMENTS 6,059,460 A * 5/2000 Ono ..... F16C 9/00 384/283
6,089,756 A * 7/2000 Ono ..... F16C 9/00 384/283
2008/0063442 A1 3/2008 Yagi et al.
2009/0129836 A1 5/2009 Sakaya et al.
2010/0034548 A1 2/2010 Naitoh et al.
(Continued)

FOREIGN PATENT DOCUMENTS

JP 2002-040860 2/2002
JP 2009-037078 2/2009
JP 2016-038545 3/2016

OTHER PUBLICATIONS

U.S. Appl. No. 15/192,521, filed Jun. 24, 2016.

*Primary Examiner* — Sophia S Chen
(74) *Attorney, Agent, or Firm* — Oblon, McClelland, Maier & Neustadt, L.L.P.

(57) ABSTRACT

A fixing device includes a drive roller, a driven roller driven to rotate by the drive roller, and a braking force applicator. The driven roller presses against the drive roller to form an area of contact between the drive roller and the driven roller, through which a recording medium bearing a toner image passes. The braking force applicator applies a braking force to the driven roller to generate a shear force between the drive roller and the driven roller. The shear force acting between the drive roller and the driven roller when the drive roller and the driven roller rotate is in a range of from 15N to 25N.

15 Claims, 13 Drawing Sheets

(56) References Cited

U.S. PATENT DOCUMENTS

| | | | | |
|---|---|---|---|---|
| 2010/0178089 | A1 | 7/2010 | Fukuhata | |
| 2010/0272481 | A1 | 10/2010 | Yamamoto et al. | |
| 2011/0311283 | A1 | 12/2011 | Fukuhata | |
| 2013/0004216 | A1 | 1/2013 | Ikeda | |
| 2013/0004217 | A1 | 1/2013 | Ikeda et al. | |
| 2013/0336671 | A1* | 12/2013 | Tamaki | G03G 15/2053 399/67 |
| 2014/0099146 | A1 | 4/2014 | Fujii et al. | |
| 2014/0374987 | A1 | 12/2014 | Uehara et al. | |
| 2015/0323892 | A1* | 11/2015 | Sakamaki | G03G 15/2053 399/327 |
| 2016/0041511 | A1 | 2/2016 | Fujii et al. | |

* cited by examiner

FIXING DEVICE, FIXING METHOD, AND IMAGE FORMING APPARATUS

CROSS-REFERENCE TO RELATED APPLICATION

This patent application is based on and claims priority pursuant to 35 U.S.C. §119(a) to Japanese Patent Application No. 2015-158343, filed on Aug. 10, 2015, in the Japan Patent Office, the entire disclosure of which is hereby incorporated by reference herein.

BACKGROUND

Technical Field

Embodiments of the present disclosure generally relate to a fixing device, a fixing method, and an image forming apparatus, and more particularly, to a fixing device for fixing a toner image on a recording medium, a fixing method for fixing a toner image on a recording medium, and an image forming apparatus incorporating the fixing device.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor serving as an image carrier. An optical writer irradiates the surface of the photoconductor thus charged with a light beam to form an electrostatic latent image on the surface of the photoconductor according to the image data. A development device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium carrying the toner image to fix the toner image onto the recording medium. Thus, the image is formed on the recording medium.

Such a fixing device typically includes a fixing rotary body such as a roller, a belt, or a film, and an opposed rotary body such as a roller or a belt pressed against the fixing rotary body. The toner image is fixed onto the recording medium under heat and pressure while the recording medium is conveyed between the fixing rotary body and the opposed rotary body.

SUMMARY

In one embodiment of the present disclosure, a novel fixing device is described that includes a drive roller, a driven roller driven to rotate by the drive roller, and a braking force applicator. The driven roller presses against the drive roller to form an area of contact between the drive roller and the driven roller, through which a recording medium bearing a toner image passes. The braking force applicator applies a braking force to the driven roller to generate a shear force between the drive roller and the driven roller. The shear force acting between the drive roller and the driven roller when the drive roller and the driven roller rotate is in a range of from 15N to 25N.

Also described is a novel fixing method that includes fixing a toner image on a recording medium passing between a drive roller and a driven roller driven to rotate by the drive roller and pressing against the drive roller, and generating a shear force between the drive roller and the driven roller, the shear force acting between the drive roller and the driven roller when the drive roller and the driven roller rotate being in a range of from 15N to 25N.

Also described is a novel image forming apparatus incorporating the fixing device.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

Figure 1:
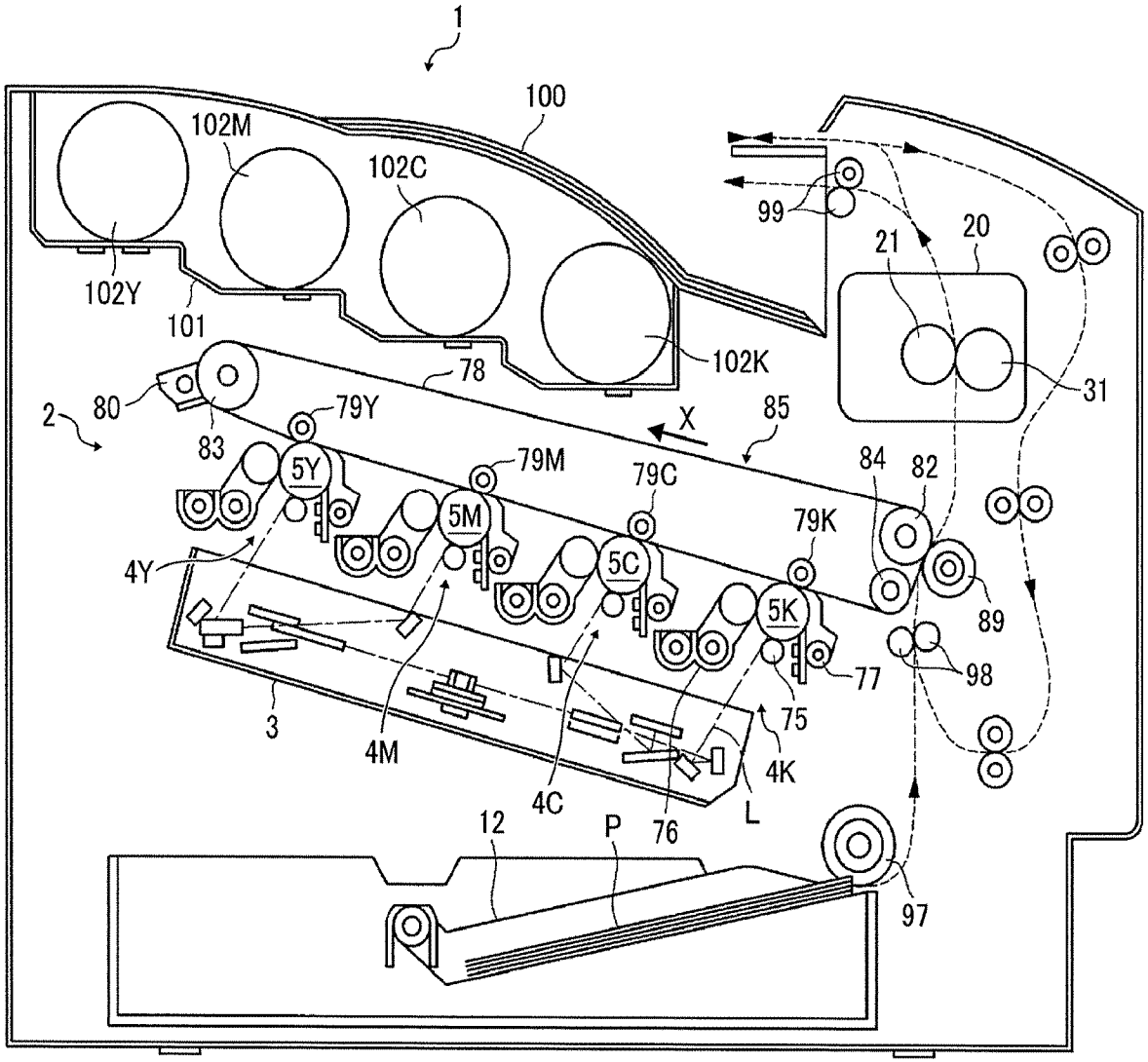
FIG. 1 is a schematic view of an image forming apparatus according to an embodiment of the present disclosure.

The accompanying drawings are intended to depict embodiments of the present disclosure and should not be interpreted to limit the scope thereof.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of the present disclosure are not necessarily indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

Referring now to the drawings, wherein like reference numerals designate identical or corresponding parts throughout the several views, embodiments of the present disclosure are described below.

Initially with reference to FIG. 1, a description is given of a configuration and an operation of an image forming apparatus 1 according to an embodiment of the present disclosure.

FIG. 1 is a schematic view of the image forming apparatus 1.

According to the present embodiment, the image forming apparatus 1 is a tandem color printer that forms color and monochrome toner images on recording media by electrophotography.

In an upper portion of the image forming apparatus 1 is a bottle container 101 that accommodates four toner bottles 102Y, 102M, 102C and 102K. The four toner bottles 102Y, 102M, 102C and 102K respectively contain fresh yellow, magenta, cyan, and black toners, and are removably attached to the bottle container 101 for replacement.

Below the bottle container 101 is an intermediate transfer unit 85. The intermediate transfer unit 85 includes, e.g., an intermediate transfer belt 78 and primary-transfer bias rollers 79Y, 79M, 79C and 79K. The intermediate transfer belt 78 is disposed opposite four imaging devices 4Y, 4M, 4C and 4K. The imaging devices 4Y, 4M, 4C and 4K are arranged side by side along the intermediate transfer belt 78, and respectively form toner images of yellow, magenta, cyan, and black. The imaging devices 4Y, 4M, 4C and 4K respectively include drum-shaped photoconductors 5Y, 5M, 5C and 5K.

Each of the photoconductors 5Y, 5M, 5C and 5K is surrounded by various pieces of imaging equipment, such as a charging device 75, a developing device 76, a cleaning device 77 and a charge neutralizing device. It is to be noted that, in FIG. 1, reference numerals 75 through 77 are assigned to the charging device, the developing device and the cleaning device, respectively, of the imaging device 4K only. The imaging devices 4Y, 4M, 4C and 4K have identical configurations, differing from each other only in the color of toner.

A series of imaging processes, namely, a charging process, an exposure process, a developing process, a primary transfer process and a cleaning process are performed on each of the photoconductors 5Y, 5M, 5C and 5K. Accordingly, the toner images of yellow, magenta, cyan, and black are formed on the photoconductors 5Y, 5M, 5C and 5K, respectively. A driving motor drives and rotates the photoconductors 5Y, 5M, 5C and 5K in a clockwise direction in FIG. 1.

In the charging process, the surfaces of the photoconductors 5Y, 5M, 5C and 5K are uniformly charged at a position opposite the respective charging devices 75.

In the exposure process, the photoconductors 5Y, 5M, 5C and 5K are rotated further and reach a position opposite an exposure device 3, where the surfaces of the photoconductors 5Y, 5M, 5C and 5K are scanned with and exposed by light beams L emitted from the exposure device 3 to form the electrostatic latent images of yellow, magenta, cyan, and black on the surfaces of the photoconductors 5Y, 5M, 5C and 5K, respectively.

In the developing process, the photoconductors 5Y, 5M, 5C and 5K are rotated further and reach a position opposite the respective developing devices 76, where the electrostatic latent images are developed with toner of yellow, magenta, cyan, and black into visible images, also known as toner images of yellow, magenta, cyan, and black, respectively.

In the primary transfer process, the photoconductors 5Y, 5M, 5C and 5K are rotated further and reach a position opposite the primary-transfer bias rollers 79Y, 79M, 79C and 79K, respectively, via the intermediate transfer belt 78, where the toner images are primarily transferred from the photoconductors 5Y, 5M, 5C and 5K onto the intermediate transfer belt 78.

At this time, a small amount of toner may remain untransferred on the surfaces of the photoconductors 5Y, 5M, 5C and 5K as residual toner.

In the cleaning process, the photoconductors 5Y, 5M, 5C and 5K are rotated further and reach a position opposite the respective cleaning devices 77, where the residual toner on the surfaces of the photoconductors 5Y, 5M, 5C and 5K are mechanically collected by respective cleaning blades of the cleaning devices 77.

Finally, the photoconductors 5Y, 5M, 5C and 5K are rotated and reach a position opposite the respective neutralizing devices, where residual potential is removed from the respective surfaces of the photoconductors 5Y, 5M, 5C and 5K.

Thus, a series of imaging processes performed on the surfaces of the photoconductors 5Y, 5M, 5C and 5K is completed.

A detailed description is now given of transfer processes performed on the intermediate transfer belt 78. The toner images formed on the surfaces of the photoconductors 5Y, 5M, 5C and 5K through the developing process are primarily transferred onto the intermediate transfer belt 78 while being superimposed one atop another, to form a color toner image on the intermediate transfer belt 78.

In addition to the intermediate transfer belt 78 and the four primary-transfer bias rollers 79Y, 79M, 79C and 79K, the intermediate transfer unit 85 includes, e.g., a secondary-transfer backup roller 82, a cleaning backup roller 83, a tension roller 84 and an intermediate transfer cleaner 80.

The intermediate transfer belt 78 is entrained around and supported by the three rollers 82 through 84, namely, the secondary-transfer backup roller 82, the cleaning backup roller 83 and the tension roller 84. Thus, the intermediate transfer belt 78 is formed into an endless loop. The intermediate transfer belt 78 is rotated in a rotational direction X, which is a counterclockwise direction indicated by arrow X in FIG. 1, by rotation of the secondary-transfer backup roller 82. The primary-transfer bias rollers 79Y, 79M, 79C and 79K sandwich the intermediate transfer belt 78 together with the photoconductors 5Y, 5M, 5C and 5K to form four areas of contact herein called primary transfer nips, respectively.

Each of the primary-transfer bias rollers 79Y, 79M, 79C and 79K is applied with a transfer bias having a polarity opposite a polarity of toner. As the intermediate transfer belt 78 rotates in the rotational direction X and successively travels through the four primary transfer nips, the toner images formed on the respective surfaces of the photoconductors 5Y, 5M, 5C and 5K are primarily transferred onto the intermediate transfer belt 78 while being superimposed one atop another to form a color toner image on the intermediate transfer belt 78.

Then, the intermediate transfer belt 78 bearing the color toner image reaches a position opposite a secondary transfer roller 89, where the secondary-transfer backup roller 82 sandwich the intermediate transfer belt 78 together with the secondary transfer roller 89 to form an area of contact herein called a secondary transfer nip. At the secondary transfer nip, the color toner image is secondarily transferred from the intermediate transfer belt 78 onto a recording medium P conveyed.

At this time, a small amount of toner may remain untransferred on the intermediate transfer belt 78 as residual toner. Then, the intermediate transfer belt 78 reaches a position opposite the intermediate transfer cleaner 80, where the residual toner is collected from the intermediate transfer belt 78.

Thus, a series of transfer processes performed on the intermediate transfer belt 78 is completed. As described above, an image forming device 2 including, e.g., the imaging devices 4 and the intermediate transfer unit 85 forms the toner images of yellow, magenta, cyan, and black constituting the color toner image.

With continued reference to FIG. 1, a detailed description is now given of conveyance of the recording medium P. The recording medium P conveyed to the secondary transfer nip as described above comes from a sheet feeder 12, which is disposed in a lower portion of the image forming apparatus 1, through a sheet-feeding roller 97, a timing roller pair 98 (e.g., a registration roller pair), and the like.

The sheet feeder 12 accommodates a plurality of recording media P, such as transfer sheets, resting one atop another. When the sheet-feeding roller 97 is rotated in the counterclockwise direction in FIG. 1, an uppermost recording medium P of the plurality of recording media P is fed toward an area of contact, herein called a roller nip, between rollers of the timing roller pair 98. The recording medium P conveyed to the timing roller pair 98 temporarily stops at the roller nip, as the timing roller pair 98 stops rotating.

The timing roller pair 98 is rotated again to convey the recording medium P to the secondary transfer nip in synchronization with the movement of the intermediate transfer belt 78 bearing the color toner image, such that the color toner image is secondarily transferred onto the recording medium P at the secondary transfer nip.

Thereafter, the recording medium P bearing the color toner image is conveyed to a fixing device 20, which includes, e.g., a fixing roller 21 and a pressure roller 31. In the fixing device 20, the color toner image is fixed onto the recording medium P under heat and pressure applied by the fixing roller 21 and the pressure roller 31.

Then, the recording medium P bearing the fixed color toner image passes through a sheet-ejection roller pair 99, which ejects the recording medium P onto an output tray 100 located outside the main body of the image forming apparatus 1. Thus, the plurality of recording media P bearing output images rest one atop another on the output tray 100. Accordingly, a series of image forming processes performed in the image forming apparatus 1 is completed.

Figure 2:
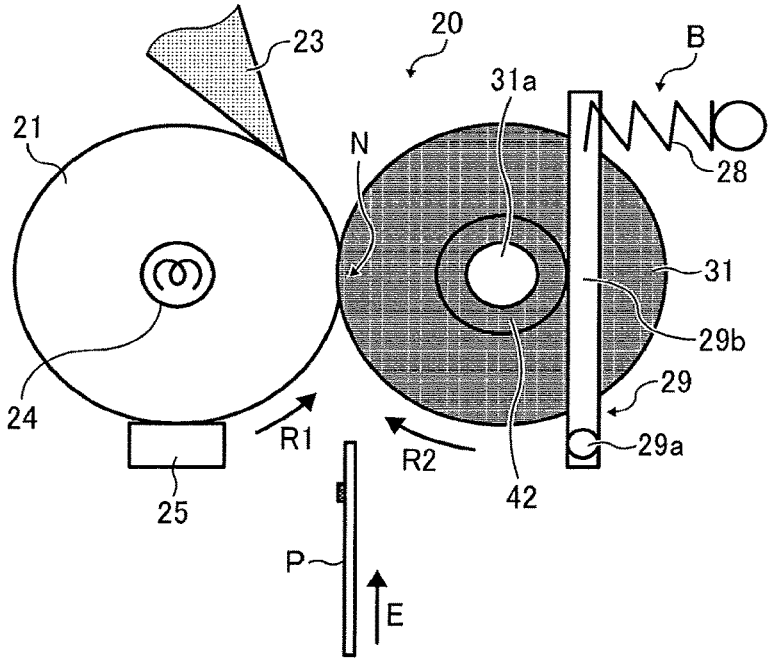
FIG. 2 is a schematic cross-sectional view of the fixing device incorporated in the image forming apparatus of FIG. 1.

Referring now to FIG. 2, a description is given of an exemplary basic configuration of the fixing device 20 incorporated in the image forming apparatus 1 described above.

FIG. 2 is a schematic cross-sectional view of the fixing device 20.

Figure 3:
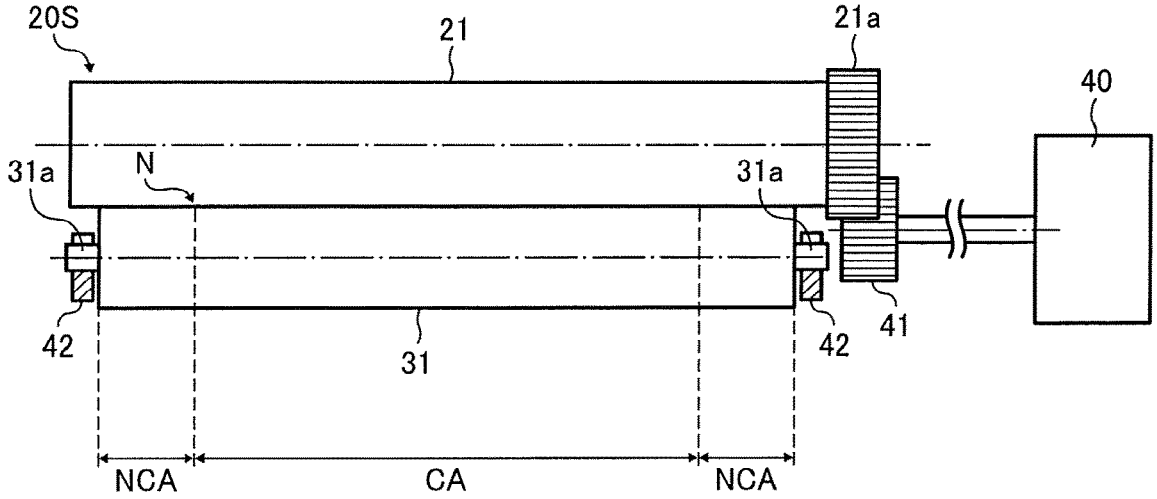
FIG. 3 is a schematic side view of a fixing device according to a first embodiment of the present disclosure.

As illustrated in FIG. 2 and described above, the fixing device 20 includes two rollers, namely, the fixing roller 21 and the pressure roller 31. The fixing roller 21 and the pressure roller 31 contact each other and form an area of contact, herein called a fixing nip N. Inside the fixing roller 21 is a halogen heater 24 serving as a heater to heat the fixing roller 21. Alternatively, the fixing device 20 may include a heater that heats the fixing roller 21 from an outer circumferential surface side of the fixing roller 21, that is, from outside the fixing roller 21. In the present embodiment, the fixing roller 21 is coupled to a driver 40, which is illustrated in FIG. 3, and rotated in a direction indicated by arrow R1 in FIG. 2. The rotation of the fixing roller 21 rotates the pressure roller 31 in a direction indicated by arrow R2 in FIG. 2.

The fixing roller 21 is a cylinder with a heat-conductive base body coated by a releasing layer. The heat-conductive base body particularly includes a high heat-conductive material with a certain mechanical strength such as carbon steel or aluminum. The releasing layer, which constitutes an outer circumferential surface of the fixing roller 21, includes a material that reliably releases toner while having a high thermal conductivity and a high durability. For example, the releasing layer as a coating layer is a tube made of fluororesin or perfluoro alkoxy (PFA), or a rubber layer such as a silicone-rubber layer or a fluoro-rubber layer. Alternatively, a coating material made of fluororesin such as PFA or polytetrafluoroethylene (PTFE) may be used as the releasing layer.

The pressure roller 31 is a cylinder constituted of a cored bar, an elastic layer formed on an outer circumference of the cored bar, and a coating layer coating the elastic layer. The cored bar is, e.g., a carbon steel tube for machine structural purposes (STKM, JIS standard). The elastic layer is silicone rubber or fluororubber. Alternatively, the elastic layer may be a silicone-rubber foam or a fluoro-rubber foam. The coating layer is a tube made of heat-resistant fluororesin such as PFA or PTFE with a high releasability.

As illustrated in FIG. 2, the pressure roller 31 is pressed against the fixing roller 21 by a biasing mechanism B using, e.g., a spring. Specifically, the biasing mechanism B includes a compression spring 28 and a biased lever 29 pivoted on a fixed point 29*a* and slidable right and left. The compression spring 28 presses a leading end portion of the biased lever 29, thereby pressing an intermediate portion 29*b* of the biased lever 29 toward a rotational shaft 31*a* of the pressure roller 31.

As illustrated on an upper side of FIG. 2, a claw-shaped separator 23 having a sharp tip is disposed facing the fixing roller 21, downstream from the fixing nip N in a recording medium conveyance direction E in which a recording medium P is conveyed. In the present embodiment, four separators 23 are aligned axially along the fixing roller 21. However, the number of separators 23 is not limited to four provided that a plurality of separators 23 are aligned.

The separators 23 include a material with a high releasability and a high slidability such as PFA, polyetherketone (PEK), or polyether ether ketone (PEEK), particularly. The separators 23 may have an outer circumferential surface coated by a material with a high releasability and a high slidability such as PFA or Teflon® (registered trademark).

Each of the separators 23 is provided with a contact-direction biasing member, which presses the corresponding separator 23 against the fixing roller 21, thereby bringing the corresponding separator 23 into contact with the fixing roller 21. The contact-direction biasing member is, e.g., a coil spring such as a compression coil spring and a tension spring. Alternatively, another biasing member may be used as the contact-direction biasing member in consideration of various conditions such as installation space and production costs.

The fixing roller 21 is surrounded by, e.g., a thermistor 25 serving as a temperature detector and a thermostat for regulating temperature. The thermistor 25 outputs a detection signal so that the surface temperature of the fixing roller 21 is controlled within a predetermined temperature range.

Referring now to FIG. 3, a description is given of a fixing device 20S according to a first embodiment of the present disclosure.

FIG. 3 is a schematic side view of the fixing device 20S.

As illustrated in FIG. 3, the fixing device 20S includes, e.g., a fixing roller 21 and a pressure roller 31. The fixing roller 21 has one end portion provided with a gear 21*a* continuous in a circumferential direction of the fixing roller 21, whereas the driver 40 such as a motor is provided with a drive gear 41. The fixing roller 21 is coupled to the driver 40 via the gear 21*a* engaged with the drive gear 41. When the driver 40 starts running, a driving force is transmitted from the driver 40 to the fixing roller 21 through the gear 21*a* to rotate the fixing roller 21.

By contrast, the pressure roller 31 is rotatably supported by a plain bearing 42. Specifically, the plain bearing 42 supports the rotational shaft 31*a* of the pressure roller 31. The pressure roller 31 is rotated by the rotation of the fixing roller 21. In other words, the pressure roller 31 is a driven roller that is driven to rotate by the fixing roller 21 as a drive roller. A recording medium P is conveyed along a conveyance area CA having a predetermined width located in the center in a width direction on an outer circumferential surface of the pressure roller 31. On the other hand, non-conveyance areas NCA in which no recording medium is conveyed are defined on opposed sides of the conveyance area CA, i.e., right and left sides of the conveyance area CA in FIG. 3.

In the present embodiment, a braking force is applied to the pressure roller 31 by friction with the plain bearing 42 against the rotational shaft 31*a* of the pressure roller 31. Thus, the plain bearing 42 serves as a braking force applicator. Specifically, as illustrated in FIG. 2, the biasing mechanism B imposes a load between the fixing roller 21 and the pressure roller 31 so as to form the fixing nip N having a predetermined width. When the rotational shaft 31*a* of the pressure roller 31 receives a reaction force from the fixing roller 21 against the load imposed by the biasing mechanism B, a bearing friction is generated between the rotational shaft 31*a* and the plain bearing 42.

Generally, an antifriction bearing, also known as a rolling contact bearing, or a plain bearing, also known as a sliding contact bearing, is employed as a bearing for a fixing roller (e.g., fixing roller 21) and a pressure roller (e.g., pressure roller 31). In the present embodiment, the plain bearing 42 is employed. The plain bearing 42 generates a greater bearing friction than that of the antifriction bearing. In other words, the plain bearing 42 imposes a greater rotational load than that of the antifriction bearing. Such bearing friction or rotational load generates a circumferential component of a shear force of from 15N to 25N, which is described below.

Specifically, the bearing friction or rotational load acting on the pressure roller 31 as a driven roller generates the shear force of from 15N to 25N at the fixing nip N. Factors or parameters that have an influence on the shear force includes, e.g., a fixing nip width, the load imposed between rollers, a roller shaft length, a frictional force generated between rollers, a rotational load (e.g., bearing friction, brake) of rollers. The rotational load or bearing friction of rollers includes, e.g., shaving of a skin layer or convex portions 42*a* through 42*c* of the plain bearing 42 described below.

Figure 4A:
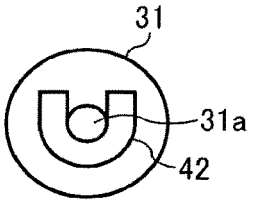
FIG. 4A is a cross-sectional shaft-end view of an exemplary plain bearing for a pressure roller incorporated in the fixing device of FIG. 3.
Figure 4B:
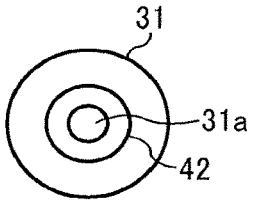
FIG. 4B is a cross-sectional shaft-end view of another exemplary plain bearing for the pressure roller incorporated in the fixing device of FIG. 3.

FIGS. 4A and 4B illustrate examples of the plain bearing 42. FIG. 4A is a cross-sectional shaft-end view of a U-shaped plain bearing 42. FIG. 4B is a cross-sectional shaft-end view of a cylindrical plain bearing 42.

Either example of the plain bearing 42 may be employed to support the rotational shaft 31*a* of the pressure roller 31. The plain bearing 42 is made of, e.g., tetrafluoroethylene (TFE), polyimide (PI), polyamideimide (PAI) or polyphenylene sulfide (PPS).

FIGS. 5A through 7B illustrate some examples of the plain bearing 42 before and after use, particularly illustrating different convex portions 42*a* through 42*c*, each of which constitutes a shaft-hole sliding surface of the plain bearing 42.

Figure 5C:
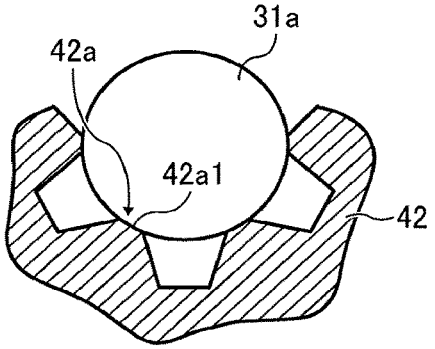
FIG. 5C is an enlarged cross-sectional shaft-end view of the plain bearing of FIG. 5A after use over time.

Each of the convex portions 42*a* through 42*c* has a V-shaped tip, forming a triangular prism. The V-shaped tip are gradually worn down by friction against the rotational shaft 31*a*, which is made of iron, thereby enlarging surface-contact areas 42*a*1, 42*b*1 and 42*c*1, each of which contacts the surface of the rotational shaft 31*a*, during operation over time, as illustrated in FIGS. 5C, 6B and 7B, respectively. Such an increase in contact areas and powder generated due to abrasion increase the coefficient of friction during operation over time.

It is to be noted that the plain bearing 42 may initially include the surface-contact areas 42*a*1 through 42*c*1 with a predetermined area so as to prevent the rotational shaft 31*a* from being damaged due to stress concentration from the convex portions 42*a* through 42*c* under, e.g., high load settings of the biasing mechanism B. In short, the convex portions 42*a* through 42*c* are trapezoids, instead of triangular prisms. Such a case also results in enlargement of the surface-contact areas 42*a*1 through 42*c*1 during operation over time.

Figure 5A:
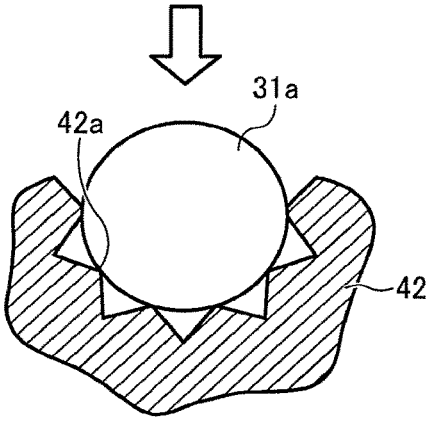
FIG. 5A is a cross-sectional shaft-end view of an exemplary plain bearing incorporated in the fixing device of FIG. 3, particularly illustrating convex portions of the plain bearing before use.
Figure 5B:
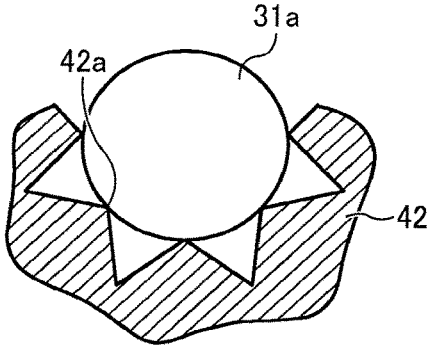
FIG. 5B is an enlarged cross-sectional shaft-end view of the plain bearing of FIG. 5A.

FIG. 5A is a cross-sectional shaft-end view of an example of the plain bearing 42 before use. FIG. 5B is an enlarged cross-sectional shaft-end view of the plain bearing 42 of FIG. 5A. FIG. 5C is a cross-sectional shaft-end view of the plain bearing 42 of FIG. 5A after use over time.

The convex portions or notches 42*a* are formed around the circumference of the shaft-hole sliding face of the plain bearing 42. These convex portions 42*a* have tips slidably contacting an outer circumferential surface of the rotational shaft 31*a*. Each of the convex portions 42*a* has a predetermined length axially along the plain bearing 42.

As the tips of the convex portions 42*a* are worn down by friction against the rotational shaft 31*a* while the number of recording media P conveyed through the fixing nip N increases, the surface-contact areas 42*a*1 are gradually enlarged as illustrated in FIG. 5C. In the meantime, the initial bearing friction at a small contact area of the plain bearing 42 does not decrease, but is kept stable or slightly increasing. Eventually, the initial driving torque of the fixing roller 21 does not decrease, but is kept stable or slightly increasing.

Figure 6A:
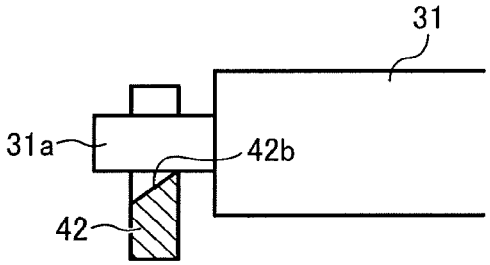
FIG. 6A is a cross-sectional shaft-end view of another exemplary plain bearing incorporated in the fixing device of FIG. 3, particularly illustrating convex portions of the plain bearing before use.
Figure 6B:
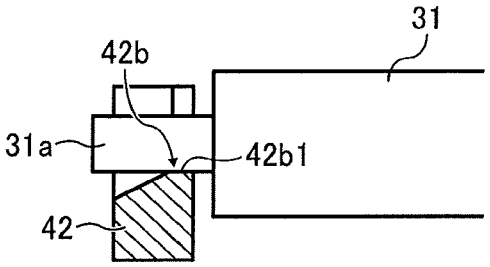
FIG. 6B is a cross-sectional shaft-end view of the plain bearing of FIG. 6A after use over time.

FIG. 6A is a cross-sectional shaft-end view of another example of the plain bearing 42 before use. FIG. 6B is a cross-sectional shaft-end view of the plain bearing 42 of FIG. 6A after use over time.

In this example, the convex portions 42*b* are formed around the circumference of a shaft hole of the plain bearing 42 on the one hand. On the other hand, the convex portions 42*b* are formed against an edge on one side, while being tapered on the other side, in an axial direction of the shaft hole of the plain bearing 42. The convex portions 42*b* may be formed against either side (i.e., right or left side in FIG. 6A). Preferably, the convex portions 42*b* may be formed against an edge on a closer side to the pressure roller 31 for stability.

The convex portions 42*b* have tips slidably contacting the outer circumferential surface of the rotational shaft 31*a* at approximately 180 degrees. As the tips of the convex portions 42*b* are worn down by friction against the rotational shaft 31*a* while the number of recording media P conveyed through the fixing nip N increases, the surface-contact areas 42*b*1 are gradually enlarged as illustrated in FIG. 6B. In the meantime, the initial bearing friction at a small contact area of the plain bearing 42 does not decrease, but is kept stable or slightly increasing. Eventually, the initial driving torque of the fixing roller 21 does not decrease, but is kept stable or slightly increasing.

Figure 7A:
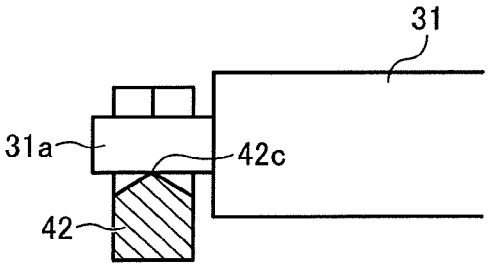
FIG. 7A is a cross-sectional shaft-end view of yet another plain bearing incorporated in the fixing device of FIG. 3, particularly illustrating convex portions of the plain bearing before use.
Figure 7B:
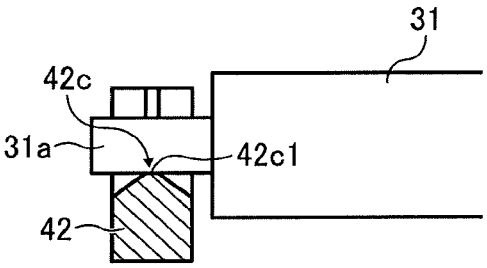
FIG. 7B is a cross-sectional shaft-end view of the plain bearing of FIG. 7A after use over time.

FIG. 7A is a cross-sectional shaft-end view of yet another example of the plain bearing 42 before use. FIG. 7B is a cross-sectional shaft-end view of the plain bearing 42 of FIG. 7A after use over time.

In this example, the convex portions 42*c* are formed around the circumference of a shaft hole of the plain bearing 42 on the one hand. On the other hand, the convex portions 42*c* are formed in the center, while being tapered symmetrically on opposed sides (i.e., right and left sides in FIG. 7A), in an axial direction of the shaft hole of the plain bearing 42.

The convex portions 42*c* formed in the center in the axial direction of the shaft hole of the plain bearing 42 prevents the axis of the plain bearing 42 from inclining against the axis of the pressure roller 31. Additionally, the plain bearing 42 employs common parts on the opposed sides, reducing the number of parts, costs of parts, and man-hours for securing assembly. Further, erroneous assembly is prevented, thereby keeping stable quality.

The convex portions 42*c* have tips slidably contacting the outer circumferential surface of the rotational shaft 31*a* at approximately 180 degrees. As the tips of the convex portions 42*c* are worn down by friction against the rotational shaft 31*a* while the number of recording media P conveyed through the fixing nip N increases, the surface-contact areas 42*c*1 are gradually enlarged as illustrated in FIG. 7B. In the meantime, the initial bearing friction at a small contact area of the plain bearing 42 does not decrease, but is kept stable or slightly increasing. Eventually, the initial driving torque of the fixing roller 21 does not decrease, but is kept stable or slightly increasing. Thus, the convex portions 42*a* through 42*c*, each of which constitutes the shaft-hole sliding surface of the plain bearing 42, are worn down by friction against the rotational shaft 31*a*, thereby maintaining or increasing the torque.

Figure 8:
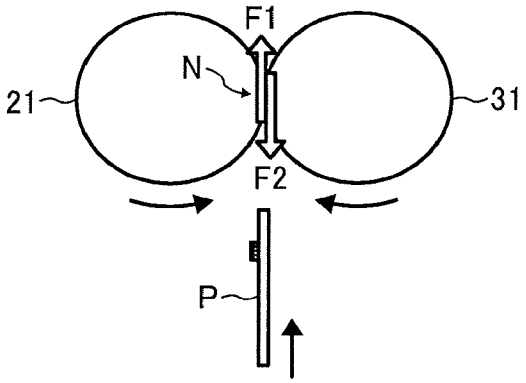
FIG. 8 is a cross-sectional view of the pressure roller and a fixing roller incorporated in the fixing device of FIG. 3, illustrating shear forces generated between the pressure roller and the fixing roller.

FIG. 8 is a cross-sectional view of the fixing roller 21 and the pressure roller 31 illustrating shear forces F1 and F2 generated between the fixing roller 21 and the pressure roller 31.

As described above, the pressure roller 31 is rotated by the rotation of the fixing roller 21. Therefore, when the pressure roller 31 receives a braking force from the plain bearing 42, the shear forces F1 and F2 are generated at the fixing nip N between the rotating fixing roller 21 and the rotated pressure roller 31 as indicated by upward arrow F1 and downward arrow F2 in FIG. 8. The shear forces F1 and F2 are conjugate shear forces having identical intensities oriented in opposite directions.

Now, a description is given of cleaning of fixing and pressure rollers of fixing devices.

Generally, in a fixing device, a toner image or toner melts under heat from at least one of the rollers of the fixing device, and is fixed on a recording medium. However, due to shortage or excess of heat, or due to electrostatic effects, a small amount of toner might fail to be fixed on the recording medium but is instead transferred to at least one of the rollers, adhering thereto as stain toner.

Figure 19:
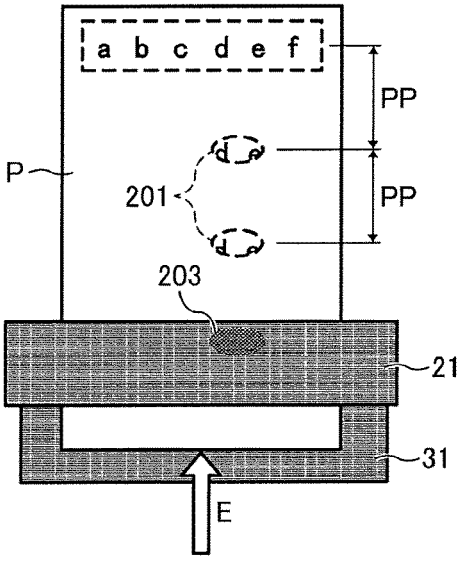
FIG. 19 is a plan view of a recording medium passing between a fixing roller and a pressure roller, bearing an offset image due to stain toner adhering to the fixing roller.

As illustrated in FIG. 19, such stain toner 203 produces a localized decrease in the releasability of toner, i.e., fixability of toner to the recording medium, from the part of a fixing roller 21 to which the stain toner 203 adheres. As a result, in the next fixing process, a toner image on the fixing roller 21 is transferred to the recording medium P as an offset image 201 at a pitch PP defined by the periphery of the fixing roller 21. Particularly, when the recording medium P contains a large amount of filler such as calcium carbonate, the filler often adheres to the fixing roller 21 and generates the offset image 201.

One approach to prevention of such an offset image involves providing a fixing method including generating a difference in traveling velocity between surfaces of a fixing member and a pressure member before a recording medium reaches a fixing nip between the fixing member and the pressure member, so as to generate a removal force for removing the stain toner.

However, such a removal force is insufficient to remove stain toner containing a large amount of paper dust, such as toner filler. Additionally, the stain toner might not be removed eventually, only be transferred from one roller (e.g., fixing member) to the opposed roller (e.g., pressure member). On top of that, the stain toner is not removed while the recording medium is passing between the fixing roller and the pressure roller.

This approach also involves execution of a predetermined cleaning sequence, which is different from a normal printing operation, thereby causing a time loss.

However, according to embodiments of the present disclosure, such stain toner adhering to a roller of the fixing device is removed during a normal printing operation while minimizing such a time loss for cleaning and obviating the need for providing a relatively large cleaner.

Specifically, according to the embodiments of the present disclosure, a shear force of from 15N to 25N acts between the two rotating rollers of the fixing device. Therefore, during the normal printing operation, a recording medium removes the stain toner from the roller with the shear force while passing between the two rollers.

Referring now to FIGS. 9A through 10C, a detailed description is given of removing toner from rollers, such as the fixing roller 21 and the pressure roller 31, with the shear forces F1 and F2.

As described above, the shear forces F1 and F2 are generated at the fixing nip N between the fixing roller 21 and the pressure roller 31. When the recording medium P passes through the fixing nip N, the shear forces F1 and F2 act between the recording medium P and the fixing roller 21 on the one hand, and between the recording medium P and the pressure roller 31 on the other hand, as illustrated in FIGS. 9B and 10B.

Figure 9A:
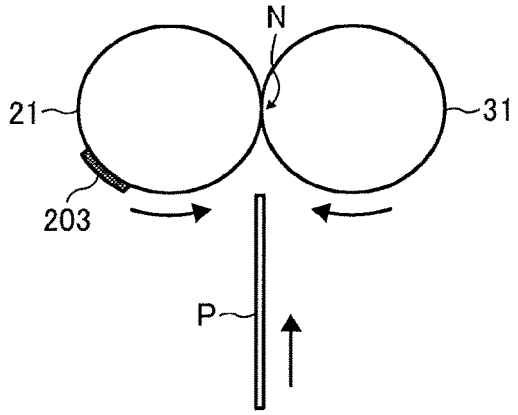
FIG. 9A is a schematic cross-sectional view of the fixing roller bearing stain toner and the pressure roller before a recording medium passes between the fixing roller and the pressure roller.

Firstly, a description is given of removing stain toner 203, which adheres to the surface of the fixing roller 21 as illustrated in FIG. 9A.

FIG. 9A is a schematic cross-sectional view of the fixing roller 21 bearing the stain toner 203 and the pressure roller 31 before a recording medium P passes through a fixing nip N between the fixing roller 21 and the pressure roller 31. FIG. 9B is a schematic cross-sectional view of the fixing roller 21 and the pressure roller 31 with the stain toner 203 and the recording medium P located at the fixing nip N. FIG. 9C is a schematic cross-sectional view of the fixing roller 21 and the pressure roller 31 after the recording medium P bearing the stain toner 203 passes through the fixing nip N.

Figure 9B:
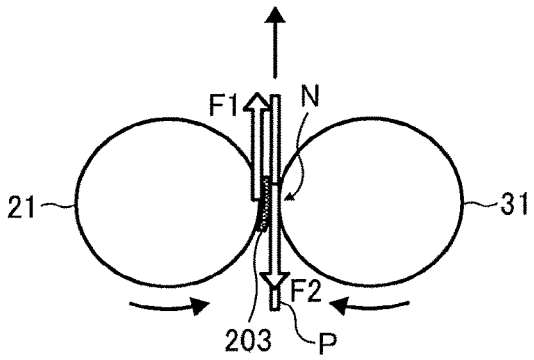
FIG. 9B is a schematic cross-sectional view of the fixing roller and the pressure roller with the stain toner and the recording medium located between the fixing roller and the pressure roller.
Figure 9C:
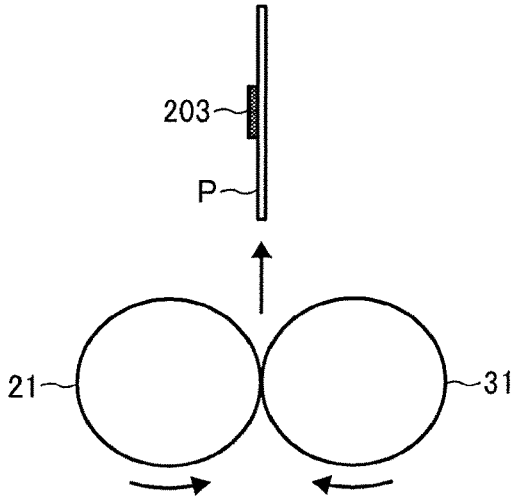
FIG. 9C is a schematic cross-sectional view of the fixing roller and the pressure roller after the recording medium bearing the stain toner passes between the fixing roller and the pressure roller.

The recording medium P removes the stain toner 203 from the fixing roller 21 while passing through the fixing nip N with the shear force F2, which is a downward force illustrated in FIG. 9B. Then, the recording medium P bearing the stain toner 203 is ejected from the fixing nip N as illustrated in FIG. 9C, and further from the fixing device 20S. It is to be noted that the amount of toner transferred onto the recording medium P is too small to degrade image quality.

Figure 10A:
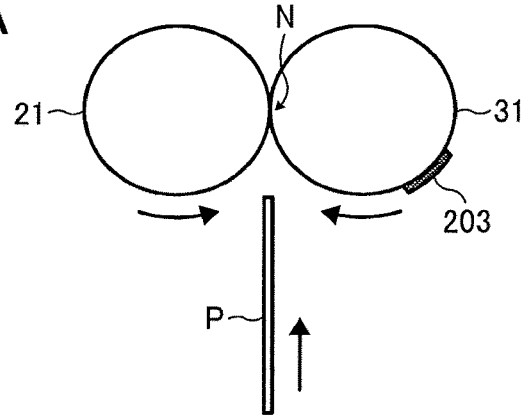
FIG. 10A is a schematic cross-sectional view of the fixing roller and the pressure roller bearing stain toner before a recording medium passes between the fixing roller and the pressure roller.
Figure 10B:
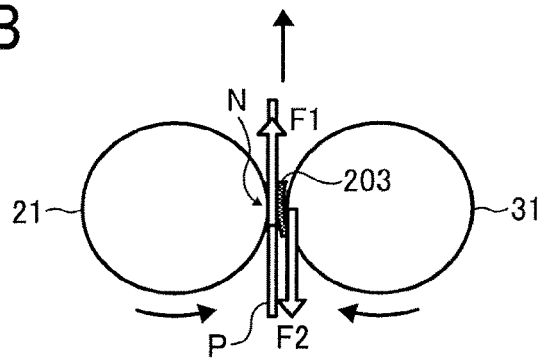
FIG. 10B is a schematic cross-sectional view of the fixing roller and the pressure roller with the stain toner and the recording medium located between the fixing roller and the pressure roller.
Figure 10C:
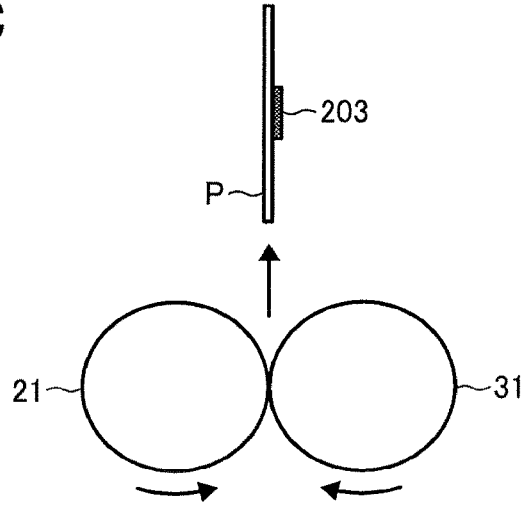
FIG. 10C is a schematic cross-sectional view of the fixing roller and the pressure roller after the recording medium bearing the stain toner passes between the fixing roller and the pressure roller.

Referring now to FIGS. 10A through 10C, a description is given of removing stain toner 203, which adheres to the surface of the pressure roller 31 in this case as illustrated in FIG. 10A.

FIG. 10A is a schematic cross-sectional view of the fixing roller 21 and the pressure roller 31 bearing the stain toner 203 before a recording medium P passes through a fixing nip N between the fixing roller 21 and the pressure roller 31. FIG. 10B is a schematic cross-sectional view of the fixing roller 21 and the pressure roller 31 with the stain toner 203 and the recording medium P located at the fixing nip N. FIG. 10C is a schematic cross-sectional view of the fixing roller 21 and the pressure roller 31 after the recording medium P bearing the stain toner 203 passes through the fixing nip N.

The recording medium P removes the stain toner 203 from the pressure roller 31 while passing through the fixing nip N with the shear force F1, which is an upward force illustrated in FIG. 10B. Then, the recording medium P bearing the stain toner 203 is ejected from the fixing nip N as illustrated in FIG. 10C, and further from the fixing device 20S.

Now, a description is given of the intensity of the shear force and torque.

In the present embodiment, a circumferential component of the shear force in a rotational direction of roller (e.g., fixing roller 21) has an intensity of from 15N to 25N. In the meantime, the fixing roller 21 has a torque of from 0.2 N·m to 0.3 N·m so as to generate such a shear force.

It is to be noted that the intensity of the circumferential component of the shear force is in a range of from 15N to 25N and the torque is in a range of from 0.2 N·m to 0.3 N·m when no recording medium exists between the fixing roller 21 and the pressure roller 31, more specifically, before the recording medium P passes between the fixing roller 21 and the pressure roller 31. It is generally quite difficult to measure the torque of a fixing roller and a shear force that act on a recording medium passing between the fixing roller and a pressure roller.

In the present embodiment, the shear force that acts on the recording medium P passing through the fixing nip N is greater than the shear force that acts on the fixing nip N when no recording medium exists at the fixing nip N, before the recording medium P passes through the fixing nip N. Accordingly, the shear force of from 15N to 25N reliably acts on the recording medium P while the recording medium P passes through the fixing nip N.

The shear force and the torque have a certain correlation. A shear force is obtained by dividing a torque by a roller radius. For example, when the roller diameter is 26 mm, i.e., the roller radius is 13 mm, the torque is obtained by multiplying the shear force by the roller radius of 13 mm.

Accordingly, when the shear force is 15N, the torque is obtained by an equation of 15 N×0.013 m=0.195 N·m. When the shear force is 25N, the torque is obtained by an equation of 25 N×0.013 m=0.325 N·m. Since the roller radius stays constant without changing over time, the shear force increases as the torque increases whereas the shear force decreases as the torque decreases.

Figure 11A:
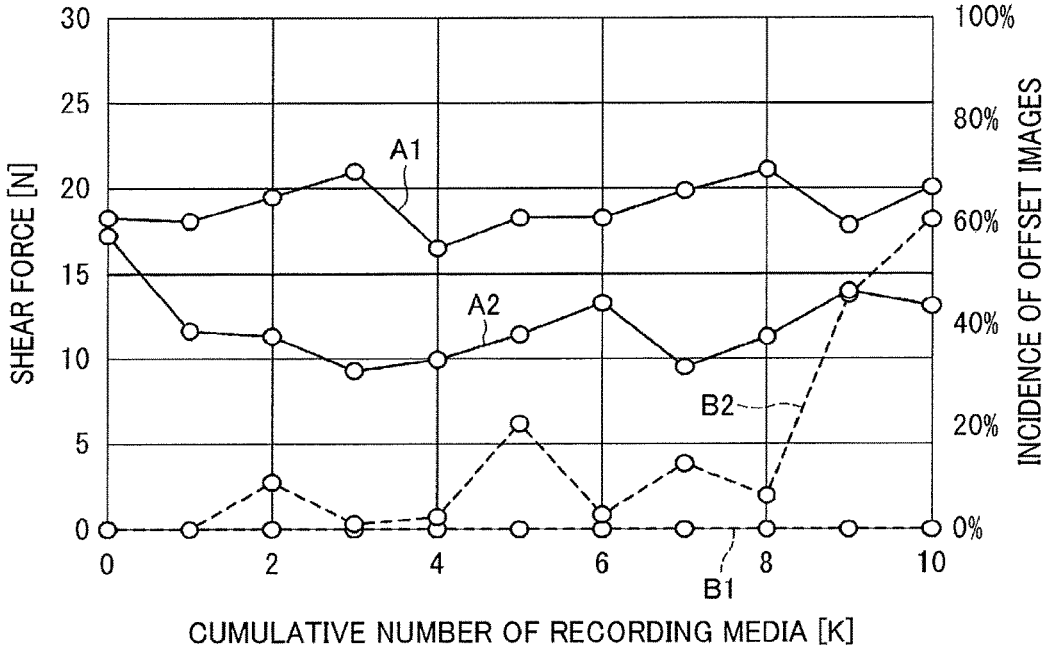
FIG. 11A is a graph illustrating changes in shear forces and the incidence of offset images with increase in the cumulative number of recording media passing between a fixing roller and a pressure roller.
Figure 11B:
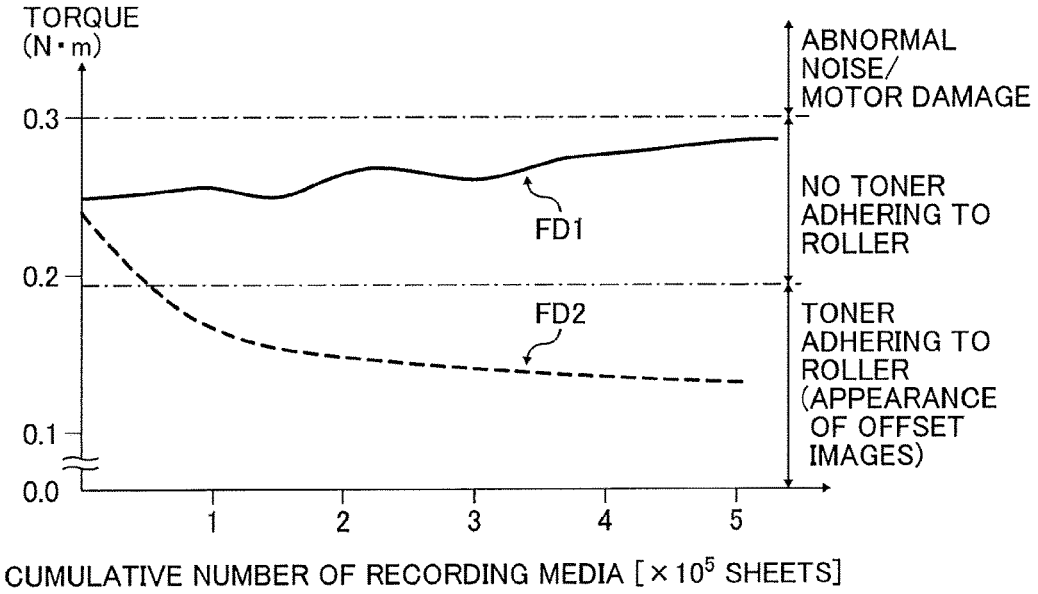
FIG. 11B is a graph illustrating changes in torque with increase in the cumulative number of recording media passing between a fixing roller and a pressure roller.

Referring to FIGS. 11A and 11B, a description is given of reasons for determining upper and lower limits of the shear force and the torque as described above.

Initially with reference to FIG. 11A, a description is given of the reason for determining the upper and lower limits of the shear force.

FIG. 11A is a graph illustrating changes in shear forces and the incidence of offset images with increase in the cumulative number of recording media passing between a fixing roller and a pressure roller.

A comparative test as a first comparative test was conducted using two fixing devices for a recording medium of A4 size. A first fixing device employed a plain bearing such as a U-shaped plain bearing and a cylindrical plain bearing as employed in the fixing device 20S according to the first embodiment of the present disclosure. A second fixing device employed a comparative plain bearing such as a U-shaped plain bearing and a cylindrical plain bearing. It is to be noted that the U-shaped plain bearing and the cylindrical plain bearing did not show significant differences in the first comparative test. In FIG. 11A, a solid line A1 indicates the intensity of a circumferential component of a shear force generated between a fixing roller and a pressure roller incorporated in the first fixing device. On the other hand, a solid line A2 indicates the intensity of a circumferential component of a shear force generated between a fixing roller and a pressure roller incorporated in the second fixing device. Each of broken lines B1 and B2 indicates the incidence of offset images attributed to toner adhering to the fixing roller.

The shear force A1 corresponds to the incidence of offset images B1. The shear force A2 corresponds to the incidence of offset images B2. The horizontal axis indicates the cumulative number, in thousands, of recording media passing between the fixing roller and the pressure roller.

As illustrated in FIG. 11A, when the circumferential component of the shear force was in a range from 15N to 25N as indicated by the solid line A1, the incidence of offset images stayed at 0% as indicated by the broken line B1. That is, the shear force A1 having a circumferential component equal to or larger than 15N was sufficient to remove stain toner from the fixing roller and minimized accumulation of the stain toner on the fixing roller. As a result, no offset image appeared. According to another comparative test, recording media tends to be wrinkled when the shear force is over 25N.

On the other hand, when the circumferential component of the shear force was less than 15N as indicated by the solid line A2, the incidence of offset images increased as the cumulative number of recording media increased, as indicated by the broken line B2. That is, the shear force A2 was too small to sufficiently remove the stain toner from the fixing roller. Therefore, as the cumulative number of recording media increased, the stain toner was accumulated on the fixing roller, resulting in the appearance of offset images.

Accordingly, in the present embodiment, the intensity of the circumferential component of the shear force is maintained in the range of from 15N to 25N to sufficiently remove the stain toner from the fixing roller 21 and relatively minimize the accumulation of the stain toner on the fixing roller 21 while preventing wrinkles on the recording media.

In FIG. 11A, at the beginning stage where the cumulative number of recording media was small, specifically less than approximately 500, the shear force A2 was equal to or larger than 15N and approximately the same as the shear force A1. However, as the cumulative number of recording media increased, the shear force A2 dropped down. In order to generate the different shear forces A1 and A2, the plain bearings having different materials were employed to support the pressure rollers in the first and second fixing devices. Since new plain bearings were employed, at the beginning stage, the difference in material of the plain bearings did not affect the shear forces or the characteristics of rotational load.

Specifically, since the plain bearings were covered by skin layers at the beginning stage, the difference in material of the plain bearings was not exhibited. However, as the skin layers were impaired and the characteristics of material itself were exhibited, the different shear forces were generated. Accordingly, in a fixing device employing a new plain bearing or its equivalent, it might be hard to determine whether the shear force is equal to or larger than 15N at the beginning stage of conveying recording media. Therefore, it is preferably determined whether the shear force is equal to or larger than 15N when the cumulative number of recording media is equal to or larger than a thousand. On the other hand, it is preferably determined whether the shear force is equal to or less than 25N when the cumulative number of recording media is equal to or less than ten thousand.

Referring now to FIG. 11B, a description is given of the reason for determining the upper and lower limits of the torque.

FIG. 11B is a graph illustrating changes in torque with increase in the cumulative number of recording media passing between a fixing roller and a pressure roller.

A comparative test as a second comparative test was conducted by use of two fixing devices for a recording medium of A4 size, which were the same as the fixing devices used in the first comparative test. Each of the first and second fixing devices included a fixing roller having a diameter of 26 mm. In FIG. 11B, a solid line FD1 indicates a plain bearing employed by a first fixing device, such as a U-shaped plain bearing and a cylindrical plain bearing as employed in the fixing device 20S according to the first embodiment of the present disclosure. A broken line FD2 indicates a comparative plain bearing employed in a second fixing device, such as a U-shaped plain bearing and a cylindrical plain bearing. It is to be noted that the U-shaped plain bearing and the cylindrical plain bearing did not show significant differences in the second comparative test.

As illustrated in FIG. 11B, the plain bearings incorporated in the first and second fixing devices had relatively high initial torques of approximately 0.25 N·m. However, as indicated by broken line FD2, the torque of the comparative plain bearing decreased to approximately 0.15 N·m early in the printing life when the cumulative number of recording media was up to approximately a hundred thousand. Then, the torque of the comparative plain bearing remained stable. Early in the printing life, the surface layer of the shaft-hole sliding surface of the comparative plain bearing was scraped off while generating powder. The powder adhered to the circumference of a rotational shaft of the pressure roller, thereby serving as a buffer or lubricant. Therefore, the torque of the comparative plain bearing decreased to approximately 0.15 N·m. However, when the torque was less than 0.2 N·m, offset images appeared on the recording medium due to stain toner adhering to, e.g., the fixing roller.

On the other hand, as indicated by solid line FD1, the torque of the plain bearing employed by the first fixing device slightly increased from 0.25 N·m early in the printing life. Then the torque gradually increased overall, but stayed less than 0.3 N·m even late in the printing life, when the cumulative number of recording media reached approximately five hundred thousand. According to another comparative test, when the torque exceeds 0.3 N·m, a drive motor receives a relatively heavy load and causes noise or may be broken.

Accordingly, in the present embodiment, the torque is maintained in the range of from 0.2 N·m to 0.3 N·m by use of the plain bearing that is scraped off during use, to prevent appearance of offset images, noise and damages on parts. Thus, the operation of the image forming apparatus 1 is kept stable.

Figure 12:
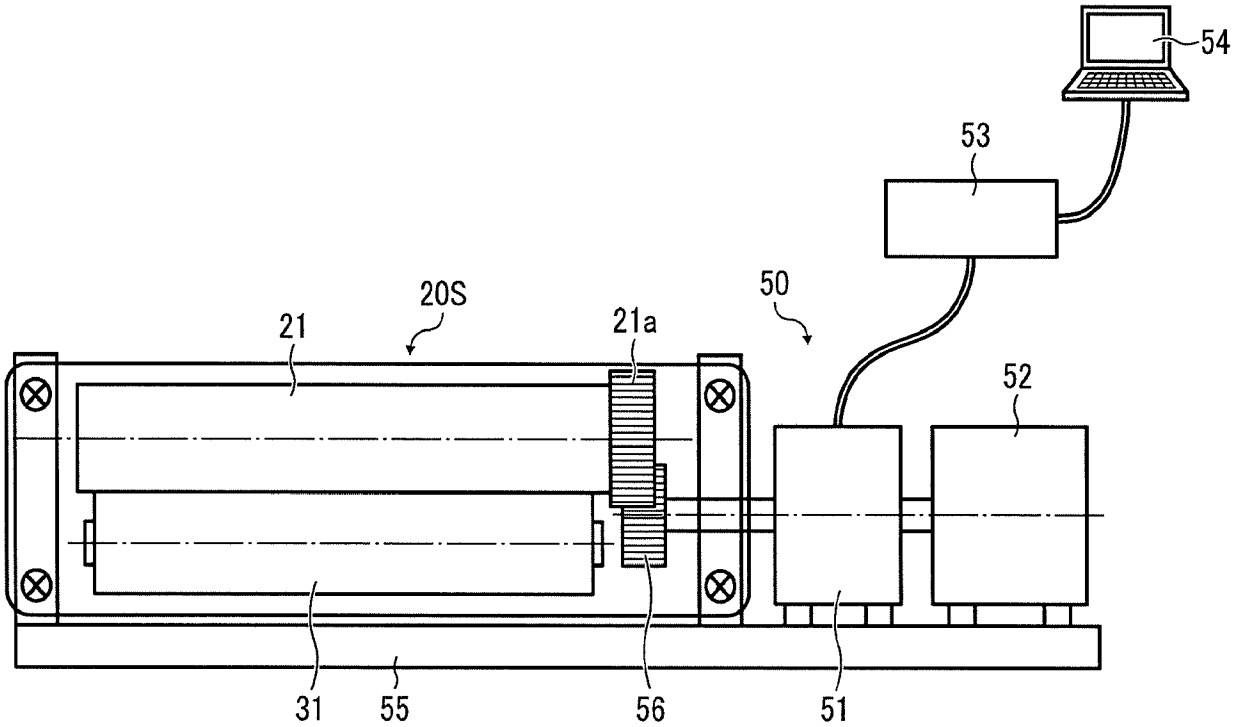
FIG. 12 is a schematic view of the fixing roller and a torque meter coupled to the fixing roller.

Referring now to FIG. 12, a description is given of a torque meter 50.

FIG. 12 is a schematic view of the fixing roller 21 and the torque meter 50 coupled to the fixing roller 21.

A torque Tr generated on the fixing roller 21 is a total torque generated on the fixing roller 21 before the recording medium P passes through the fixing nip N. The total torque of the fixing roller 21 is measured by, e.g., the torque meter 50 illustrated in FIG. 12.

The torque meter 50 includes a torque converter 51, a motor 52, a signal conditioner 53, a computer 54 and a base 55. The torque converter 51 and the motor 52 are disposed on the base 55. The computer 54 is connected to the torque converter 51 via the signal conditioner 53. The motor 52 includes a rotational shaft passing through the torque converter 51. A drive gear 56 is mounted on an end portion of the rotational shaft of the motor 52.

In order to measure the total torque of the fixing roller 21, firstly, the fixing device 20S including the fixing roller 21 is secured onto the base 55, so as to couple the gear 21*a* mounted on the axial end portion of the fixing roller 21 to the drive gear 56. When the motor 52 is activated, torques are generated on the fixing roller 21. The torque converter 51 measures the total torque generated on the fixing roller 21. The signal conditioner 53 converts measurement data to a predetermined signal and input the signal to the computer 54 that calculates the total torque.

The total torque Tr of the fixing roller 21 thus obtained and an average radius R of the fixing roller 21 are input into an equation of Fr=Tr/R, to obtain a circumferential component of the shear force Fr generated between the fixing roller 21 and the pressure roller 31. Accordingly, e.g., the intensity of the torque and the roller radius are adjusted such that the circumferential component of the shear force Fr thus obtained is in the range of from 15N to 25N.

In the present embodiment, the total torque of the fixing roller 21 as a drive roller is thus calculated. However, if a pressure roller is a drive roller whereas a fixing roller is a driven roller, the total torque of the pressure roller may be calculated similarly. Then, a circumferential component of the shear force Fr is calculated by use of the total torque of the pressure roller and an average radius of the pressure roller at a fixing nip between the fixing roller and the pressure roller.

Figure 13:
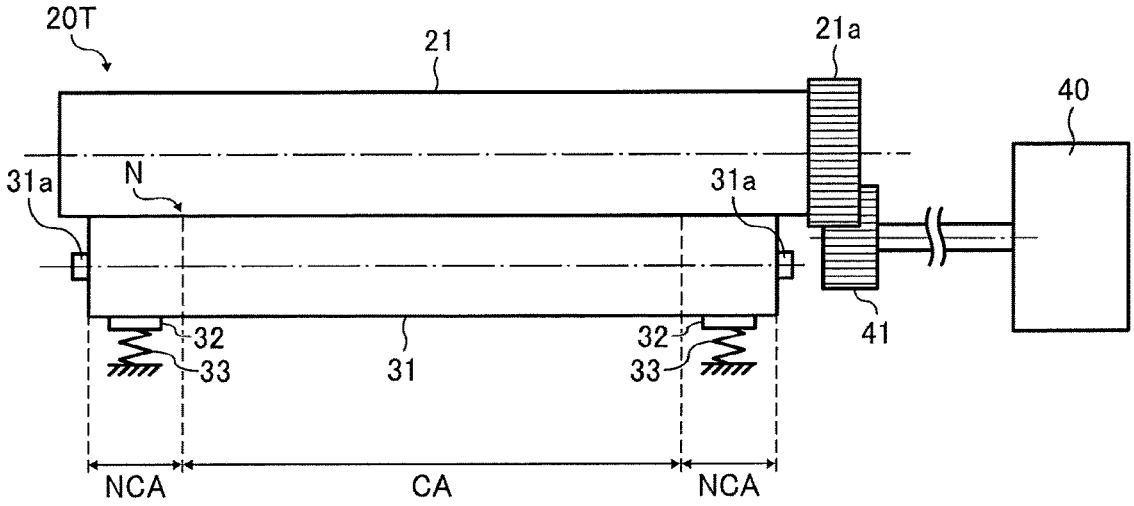
FIG. 13 is a schematic side view of a fixing device according to a second embodiment of the present disclosure.

Referring now to FIG. 13, a description is given of a fixing device 20T according to a second embodiment of the present disclosure.

FIG. 13 is a schematic side view of the fixing device 20T.

In the present embodiment, the fixing device 20T employs a typical antifriction bearing or plain bearing having a relatively small bearing friction to support a pressure roller 31, instead of the plain bearing 42 as illustrated in FIGS. 5A through 7B. Additionally, in the present embodiment, the fixing device 20T includes a brake pad 32 serving as a braking force applicator, which slidably contacts the pressure roller 31 to impose a rotational load on the pressure roller 31, and a brake spring 33 that presses the brake pad 32 against the pressure roller 31.

Specifically, as illustrated in FIG. 13, the brake spring 33 presses the brake pad 32 with a predetermined force against a non-conveyance area NCA, in which no recording medium is conveyed, such that the brake pad 32 slidably contacts the non-sheet conveyance area NCA of the pressure roller 31. Such a configuration prevents contamination of the brake pad 32 by toner, and further prevents a contaminant from flowing back to a recording medium P.

Figure 14A:
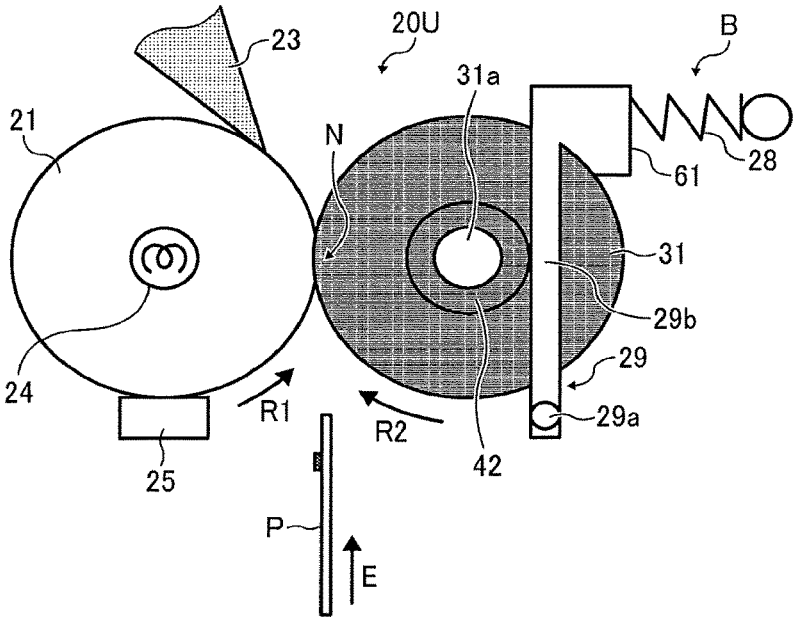
FIG. 14A is a schematic cross-sectional view of a fixing device according to a third embodiment of the present disclosure.
Figure 14B:
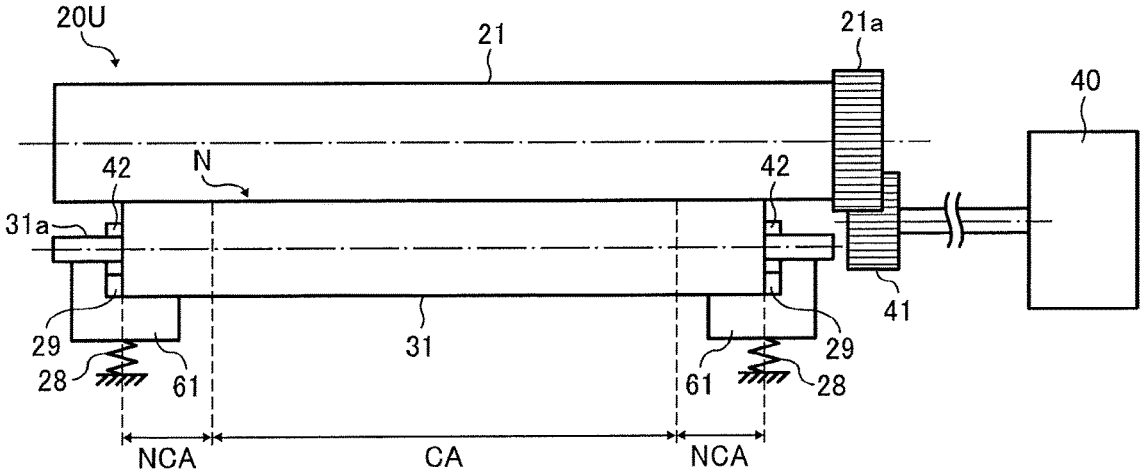
FIG. 14B is a schematic side view of the fixing device of FIG. 14A.

Referring now to FIGS. 14A and 14B, a description is given of a fixing device 20U according to a third embodiment of the present disclosure.

FIG. 14A is a schematic cross-sectional view of the fixing device 20U. FIG. 14B is a schematic side view of the fixing device 20U.

The fixing device 20U includes, e.g., a fixing roller 21, a pressure roller 31, a compression spring 28, a biased lever 29 and a brake pad 61. In the present embodiment, the fixing device 20U employs the compression spring 28, which presses the pressure roller 31 against the fixing roller 21, as a brake spring such as the brake spring 33 of FIG. 13.

Specifically, the biased lever 29 has a leading end portion integrated with the brake pad 61, such that the brake pad 61 slidably contacts a non-conveyance area NCA located at each end portion on an outer circumferential surface of the pressure roller 31. With such a configuration that obviates the need for providing the brake spring 33 of FIG. 13 and includes the brake pad 61 integrated with the biased lever 29, the number of parts and production costs are reduced. It is to be noted that an intermediate portion 29*b* of the biased lever 29 does not necessarily contact a rotational shaft 31*a* of the pressure roller 31 because the pressing force from the brake pad 61 is applied to the fixing roller 21 via the pressure roller 31. Additionally, the pressing force from the brake pad 61 remains within a predetermined area even when the pressing force from the compression spring 28 is changed so as to change the pressure at a fixing nip N between the fixing roller 21 and the pressure roller 31.

Figure 15:
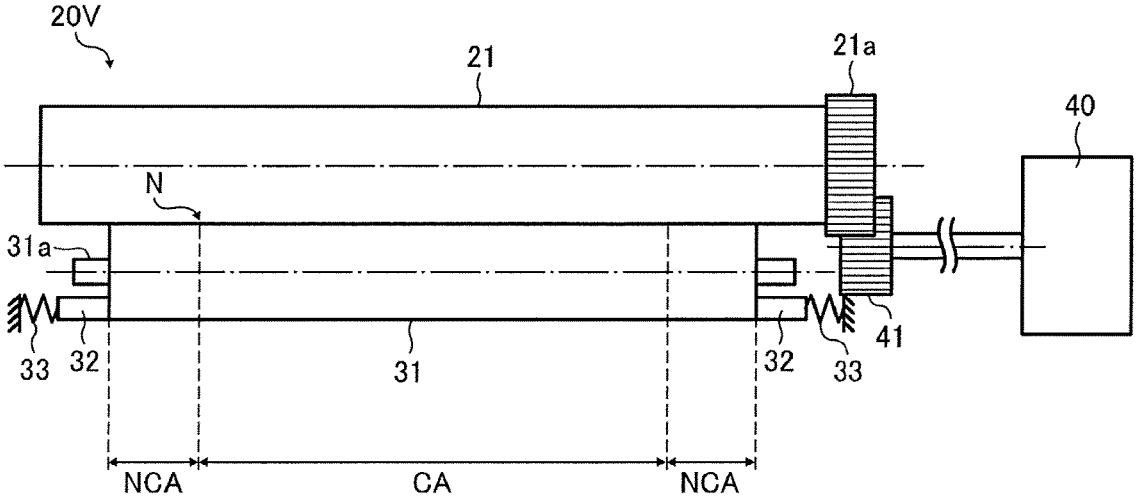
FIG. 15 is a schematic side view of a fixing device according to a fourth embodiment of the present disclosure.

Referring now to FIG. 15, a description is given of a fixing device 20V according to a fourth embodiment of the present disclosure.

FIG. 15 is a schematic side view of the fixing device 20V.

The fixing device 20V includes, e.g., a fixing roller 21, a pressure roller 31, a brake pad 32 and a brake spring 33. In the present embodiment, the fixing device 20V has a configuration in which the pressing force from the brake pad 32 does not affect the pressure at a fixing nip N between the fixing roller 21 and the pressure roller 31. Specifically, as illustrated in FIG. 15, the brake spring 33 presses the brake pad 32 against each of opposed axial end faces of the pressure roller 31 axially along the pressure roller 31, such that the brake pad 32 slidably contacts the axial end face of the pressure roller 31.

Such a configuration obviates the need to provide a non-conveyance area having a certain width which the brake pad 32 contacts, thereby downsizing the pressure roller 31. Alternatively, the brake pad 32 may be disposed to slidably contact only one of the opposed axial end faces of the pressure roller 31. Accordingly, in the present embodiment, the pressing force from the brake pad 32 does not affect the pressure at the fixing nip N, thereby preventing an axial pressure gradient or deflection between left and right at the fixing nip N.

Figure 16:
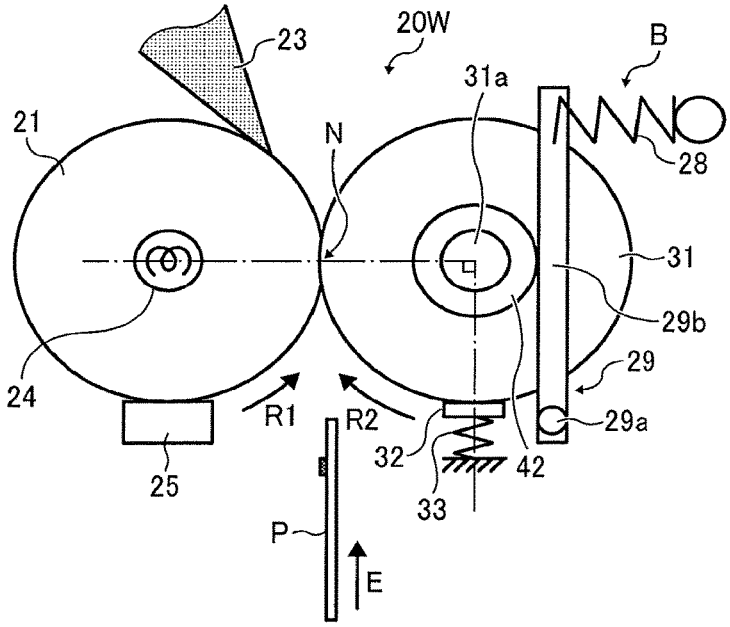
FIG. 16 is a schematic cross-sectional view of a fixing device according to a fifth embodiment of the present disclosure.

Referring now to FIG. 16, a description is given of a fixing device 20W according to a fifth embodiment of the present disclosure.

FIG. 16 is a schematic cross-sectional view of the fixing device 20W.

The fixing device 20W includes, e.g., a fixing roller 21, a pressure roller 31, a brake pad 32 and a brake spring 33. In the present embodiment, the fixing device 20W has a configuration in which the pressing force from the brake pad 32 does not affect the pressure at a fixing nip N between the fixing roller 21 and the pressure roller 31. Specifically, the brake spring 33 presses the brake pad 32 against a non-conveyance area located at each of opposed end portions on an outer circumference surface of the pressure roller 31. More specifically, the brake spring 33 presses the brake pad 32 in a direction perpendicular to a straight line between the center of the fixing roller 21 and the center of the pressure roller 31, that is, a direction parallel to a tangential direction at the fixing nip N. The brake pad 32 thus pressed by the brake spring 33 slidably contacts the non-conveyance area. Accordingly, in the present embodiment, the pressing force from the brake pad 32 does not affect the pressure at the fixing nip N, thereby preventing an axial pressure gradient or deflection between left and right at the fixing nip N.

According to the embodiments described above, the shear force acts when a recording medium P passes between the fixing roller 21 and the pressure roller 31. With such a shear force, the recording medium P removes stain toner from a roller (e.g., fixing roller 21). Thus, the removal of stain toner is enhanced compared to a typical configuration in which the shear force acts when no recording medium passes between a fixing roller and a pressure roller. Additionally, the removal of stain toner is enhanced every time the recording medium P passes between the fixing roller 21 and the pressure roller 31. Such a configuration minimizes a time loss and removes extraneous matter such as stain toner from rollers more frequently to effectively minimize accumulation of the extraneous matter, compared to a typical configuration in which the stain toner is removed in a predetermined cleaning sequence when no recording medium passes between the fixing roller and the pressure roller.

These advantages of the embodiments of the present disclosure are particularly prominent when using a recording medium containing a large amount of filler such as calcium carbonate, and when using toner containing silica particles including silicone oil as external additives. Such kind of toner is obtained by, e.g., adding two parts of hydrophobic silica RY50 (produced by Aerosil Co., Ltd.) including silicone oil on a surface or coated by silicone oil to a hundred part of ground toner or polymerization toner, conducting a mixing treatment for five minutes with a 20L HENSCHEL MIXER at a circumferential velocity of 40 m/sec., and screening the mixture with a sieve of 75-μm mesh.

Although the first through fifth embodiments of the present disclosure are described above, the present disclosure is not limited to those embodiments described heretofore, and can be applied to other embodiments by modification in various forms. For example, according to the embodiments described above, the fixing roller 21 is a drive roller whereas the pressure roller 31 is a driven roller. Alternatively, however, the pressure roller 31 may be a drive roller whereas the fixing roller 21 may be a driven roller. In such a case, a rotational load is imposed on the fixing roller 21 as a driven roller so that the shear force acts between the fixing roller 21 and the pressure roller 31.

Optionally, a cleaner may be provided to enhance the removal of toner from the fixing roller or the pressure roller.

One approach involves a method for providing a cleaner, such as a cleaning web and a cleaning roller, which removes stain toner from the surface of the pressure member. However, providing such a cleaner hampers downsizing the device and cost reduction. Additionally, the stain toner collected by the cleaner might congeal and cause noise, or a certain amount of toner might rest on the cleaner and consequently melt, resulting in contamination of the recording medium. This approach also involves execution of a predetermined cleaning sequence, which is different from a normal printing operation, thereby causing a time loss.

However, according to the embodiments of the present disclosure, such stain toner is removed during a normal printing operation while minimizing such a time loss for cleaning and obviating the need for providing a relatively large cleaner.

Figure 17:
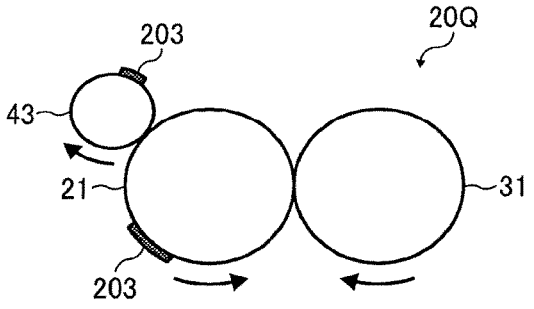
FIG. 17 is a schematic view of a fixing device incorporating a cleaner according to a sixth embodiment.
Figure 18:
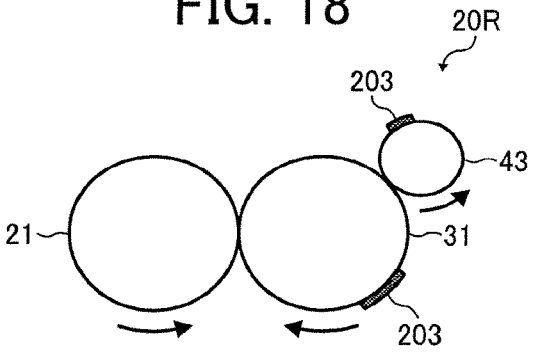
FIG. 18 is a schematic view of a fixing device incorporating a cleaner according to a seventh embodiment.

Referring now to FIGS. 17 and 18, a description is given of fixing devices according to sixth and seventh embodiments, each of which incorporates a cleaner to remove toner from a roller.

FIG. 17 is a schematic view of a fixing device 20Q according to the sixth embodiment.

The fixing device 20Q includes, e.g., a fixing roller 21, a pressure roller 31 and a cleaning roller 43 serving as a cleaner that contacts the surface of the fixing roller 21 and removes stain toner 203 from the fixing roller 21.

FIG. 18 is a schematic view of a fixing device 20R according to the seventh embodiment. The fixing device 20R includes a fixing roller 21, a pressure roller 31 and a cleaning roller 43 serving as a cleaner that contacts the surface of the pressure roller 31 and removes stain toner 203 from the pressure roller 31. Like the embodiments described above, a recording medium removes the stain toner 203 while passing between the fixing roller 21 and the pressure roller 31. Therefore, the cleaning roller 43 removes and collects a decreased amount of the stain toner 203 from the fixing roller 21 or the pressure roller 31. Accordingly, problems are prevented that toner collected by a cleaner congeals and causes noise, or that a certain amount of toner rests on the cleaner and consequently melts, resulting in contamination of recording media.

In the embodiments described above, the brake pads are in contact with the pressure roller 31. Alternatively, however, the brake pads may be separate from a roller to brake, by switching ON and OFF, for example, so that the brake pads act on the roller only when the stain toner is removed. In such a case, exclusive cleaning paper may be used as a recording medium P, instead of plain paper, to enhance removal of stain toner.

Numerous additional modifications and variations are possible in light of the above teachings. It is therefore to be understood that within the scope of the appended claims, the present disclosure may be practiced otherwise than as specifically described herein.

With some embodiments of the present disclosure having thus been described, it will be obvious that the same may be varied in many ways. Such variations are not to be regarded as a departure from the scope of the present disclosure, and all such modifications are intended to be included within the scope of the present disclosure.

For example, elements and/or features of different illustrative embodiments may be combined with each other and/or substituted for each other within the scope of the present disclosure and appended claims. The present disclosure has been described above with reference to specific embodiments. The number of constituent elements and their locations, shapes, and so forth are not limited to any of the structure for performing the methodology illustrated in the drawings. For example, the image forming apparatus incorporating the fixing device according to an embodiment described above is not limited to a color printer as illustrated in FIG. 1, but may be a monochrome printer that forms a monochrome toner image on a recording medium. Additionally, the image forming apparatus to which the embodiments of the present disclosure is applied includes but is not limited to a printer, a copier, a facsimile machine, or a multifunction peripheral having one or more capabilities of these devices.

Further, any of the above-described devices or units can be implemented as a hardware apparatus, such as a specialpurpose circuit or device, or as a hardware/software combination, such as a processor executing a software program.

What is claimed is:

1. A fixing device comprising:

a drive roller;

a driven roller driven to rotate by the drive roller, the driven roller pressing against the drive roller to form an area of contact between the drive roller and the driven roller, through which a recording medium bearing a toner image passes; and a braking force applicator to apply a braking force to the driven roller to generate a shear force between the drive roller and the driven roller, the shear force acting between the drive roller and the driven roller when the drive roller and the driven roller rotate being in a range of from 15N to 25N.

2. The fixing device according to claim 1, wherein the driven roller comprises a rotational shaft, and wherein the braking force applicator comprises a plain bearing to support the rotational shaft of the driven roller.

3. The fixing device according to claim 2, wherein the plain bearing has a shaft-hole sliding surface including a convex portion.

4. The fixing device according to claim 1, wherein the shear force generated between the drive roller and the driven roller is in the range of from 15N to 25N when a cumulative number of recording media passing between the drive roller and the driven roller is in a range of from 1,000 to 10,000.

5. The fixing device according to claim 1, wherein a shear force acting on the recording medium passing between the drive roller and the driven roller is greater than a shear force acting between the drive roller and the driven roller when no recording medium exists between the drive roller and the driven roller before the recording medium passes between the drive roller and the driven roller.

6. The fixing device according to claim 1, wherein the braking force applicator comprises a first brake pad to slidably contact the driven roller to impose a rotational load on the driven roller.

7. The fixing device according to claim 6, wherein the first brake pad slidably contacts a non-conveyance area, in which the recording medium is not conveyed, on an outer circumferential surface of the driven roller.

8. The fixing device according to claim 7, wherein the first brake pad slidably contacts the non-conveyance area in a direction parallel to a tangential direction between the drive roller and the driven roller.

9. The fixing device according to claim 6, wherein the first brake pad slidably contacts an axial end face of the driven roller.

10. The fixing device according to claim 6, further comprising a second brake pad, wherein the first brake pad and the second brake pad slidably contact opposed axial end faces of the driven roller.

11. An image forming apparatus comprising:

an image forming device to form a toner image; and a fixing device disposed downstream from the image forming device in a recording medium conveyance direction, the fixing device including:

a drive roller;

a driven roller driven to rotate by the drive roller, the driven roller pressing against the drive roller to form an area of contact between the drive roller and the driven roller, through which a recording medium bearing a toner image passes; and a braking force applicator to apply a braking force to the driven roller to generate a shear force between the drive roller and the driven roller, the shear force acting between the drive roller and the driven roller when the drive roller and the driven roller rotate being in a range of 15N to 25N.

12. A fixing method for fixing a toner image on a recording medium in an image forming apparatus, the fixing method comprising:

fixing a toner image on a recording medium passing between a drive roller and a driven roller driven to rotate by the drive roller and pressing against the drive roller; and generating a shear force between the drive roller and the driven roller, the shear force acting between the drive roller and the driven roller when the drive roller and the driven roller rotate being in a range of from 15N to 25N.

13. The fixing method according to claim 12, wherein the shear force generated between the drive roller and the driven roller is in the range of from 15N to 25N when a cumulative number of recording media passing between the drive roller and the driven roller is in a range of from 1,000 to 10,000.

14. The fixing method according to claim 12, wherein a shear force acting on the recording medium passing between the drive roller and the driven roller is greater than a shear force generated between the drive roller and the driven roller when no recording medium exists between the drive roller and the driven roller before the recording medium passes between the drive roller and the driven roller.

15. The fixing method according to claim 12, further comprising applying a braking force to the driven roller using a braking force applicator to generate the shear force between the drive roller and the driven roller.

* * * * *